US010435944B2

(12) United States Patent
Duan

(10) Patent No.: US 10,435,944 B2
(45) Date of Patent: Oct. 8, 2019

(54) DEVICE MOUNTED ON WINDOW BLIND FOR INDEPENDENT TILTING OF SLATS IN LOWER AND UPPER REGIONS

(71) Applicant: Huishan Duan, San Jose, CA (US)

(72) Inventor: Huishan Duan, San Jose, CA (US)

(73) Assignee: Huishan Duan, San Jose, CA (US)

( * ) Notice: Subject to any disclaimer, the term of this patent is extended or adjusted under 35 U.S.C. 154(b) by 24 days.

(21) Appl. No.: 15/891,317

(22) Filed: Feb. 7, 2018

(65) Prior Publication Data

US 2018/0163462 A1 Jun. 14, 2018

(51) Int. Cl.

| | |
|---|---|
| ***E06B 9/307*** | (2006.01) |
| ***E06B 9/322*** | (2006.01) |
| ***E06B 9/384*** | (2006.01) |
| *E06B 9/303* | (2006.01) |
| *E06B 9/24* | (2006.01) |

(52) U.S. Cl.

CPC ..... *E06B 9/307* (2013.01); *E06B 9/322* (2013.01); *E06B 9/384* (2013.01); *E06B 9/303* (2013.01); *E06B 2009/2441* (2013.01)

(58) Field of Classification Search

CPC ... E06B 9/30; E06B 9/38; E06B 9/384; E06B 9/303; E06B 9/307

USPC ..... 160/115

See application file for complete search history.

(56) References Cited

U.S. PATENT DOCUMENTS

| | | | | | |
|---|---|---|---|---|---|
| 2,506,507 | A * | 5/1950 | Kiatta | E06B 9/305 | 160/115 |
| 2,836,237 | A * | 5/1958 | Hogin | E06B 9/305 | 160/115 |
| 2,837,152 | A * | 6/1958 | Moore, Jr. | E06B 9/306 | 160/168.1 R |
| 2,918,121 | A * | 12/1959 | Gibble | E06B 9/382 | 160/115 |
| 4,621,672 | A * | 11/1986 | Hsu | E06B 9/307 | 160/115 |
| 4,733,711 | A * | 3/1988 | Schon | E06B 9/262 | 160/279 |
| 4,940,070 | A * | 7/1990 | Warden | E06B 9/382 | 160/115 |
| 5,119,868 | A * | 6/1992 | Werner | E06B 9/307 | 160/115 |
| 5,205,335 | A * | 4/1993 | Horton | E06B 9/303 | 160/115 |
| 5,402,840 | A * | 4/1995 | Jortner | E06B 9/382 | 160/115 |

(Continued)

*Primary Examiner* — Michael C McCullough

(57) ABSTRACT

A mechanical device comprises a master wheel assembly, one or multiple slave wheel assemblies, a control rod, a shaft assembly, as well as multiple pairs of cord holders and cords. The master and slave wheel assemblies are connected by a shaft assembly and are mounted at front edge of a top slat of a Venetian blind. One end of the paired cords is tightened to master and slave wheel assemblies, and the other end is tightened to a user-selected slat that divides the blind into an upper and a lower region. Manipulating the control rod causes master and slave wheel assemblies to tilt slats in the lower region of the blind without interfering slats in the upper region. Combining with operation of slat-adjusting system of Venetian blinds, this device can selectively tilt slats in lower and upper regions of Venetian blinds for privacy and natural lighting adjustments.

9 Claims, 12 Drawing Sheets

(56) References Cited

U.S. PATENT DOCUMENTS 5,443,108 A * 8/1995 LeVert ..... E06B 9/30 160/167 R
5,845,691 A * 12/1998 Gaines ..... E06B 9/307 160/115
6,076,587 A * 6/2000 Pastor ..... E06B 9/307 160/115
6,105,652 A * 8/2000 Judkins ..... E06B 9/307 160/115
6,196,292 B1 * 3/2001 Jackson ..... E06B 9/303 160/113
6,202,731 B1 * 3/2001 Rulon ..... E06B 9/382 160/115
6,227,279 B1 * 5/2001 Belongia ..... E06B 9/303 160/115
6,305,454 B1 * 10/2001 Judkins ..... E06B 9/322 160/113
6,318,439 B1 * 11/2001 Matsubara ..... E06B 9/307 160/115
6,419,001 B2 * 7/2002 Labbe ..... E06B 9/303 160/115
6,581,665 B2 * 6/2003 Lin ..... E06B 9/32 160/115
6,845,802 B1 * 1/2005 Anderson ..... E06B 9/307 160/115
2006/0130981 A1 * 6/2006 Marzilli ..... E06B 9/32 160/115
2006/0225844 A1 * 10/2006 Gittens ..... E06B 9/382 160/115
2012/0037322 A1 * 2/2012 Aselton ..... E06B 9/303 160/168.1 R
2012/0211176 A1 * 8/2012 Laubshire, Jr. ..... A61F 5/4556 160/115
2017/0030141 A1 * 2/2017 Cato ..... E06B 9/32
2017/0081912 A1 * 3/2017 Guillory ..... E06B 9/26
2019/0041017 A1 * 2/2019 Yui ..... E06B 9/303

* cited by examiner

DEVICE MOUNTED ON WINDOW BLIND FOR INDEPENDENT TILTING OF SLATS IN LOWER AND UPPER REGIONS

BACKGROUND OF THE INVENTION

The following include information that are useful in understanding the present invention. It is not an admission that any of the information provided herein is prior art or material to the presently described or claimed inventions, or that any publication or document that is specifically or implicitly referenced is prior art.

1. Field of this Invention

This invention is related to a mechanical device that is mounted on a Venetian-type window blind to divide the window blind into an upper and a lower region and enable the blind slats in the different regions to be opened or closed independently or selectively by the user for both privacy and better natural lighting.

2. Brief Description of Related Arts

Venetian blinds are widely used for and mounted on windows to provide privacy and adjustable natural lighting. In a conventional Venetian blind, at least two string ladders connected to a cord control system are used to support and tilt the entire set of horizontal slats as a unit for privacy and natural lighting adjustment. That is, the cord control system of a conventional Venetian blind is unable to control the tilting of slats in its different regions independently or selectively. However, some occupants of buildings, especially those in densely populated areas, may want the lower region of their windows to be blocked for privacy while wanting the upper region of their windows to be open for better natural lighting, and some other occupants may want the opposite, in order to enjoy both privacy and better natural lighting. There have been numerous improvements made for Venetian blinds so that lower region of the blind can be closed while the upper region is open, or vice versa. Such improvements are particularly described in U.S. Pat. Nos. 6,105,652, 5,443,108, 4,621,672, 4,940,070, as well as U.S. Pub. No. 2012/0211176, 2006/0225844. However, all improvements of prior arts for enabling conventional Venetian blinds with this function have at least one of deficiencies below:

- All improvements of prior arts are made on building new types of Venetian blinds, which means users have to replace their conventional Venetian blinds in order to obtain the function;
- Some of prior arts allow slats to tilt at angle range less than 90 degrees, but appropriate range of slat tilting angle is more than 160 degrees in order to achieve proper privacy and natural lighting;
- Some of prior arts are able to adjust the angle of slats in either lower or upper region independently but unable to adjust slats in both regions selectively;
- Manufacturing components of some of prior arts are either too difficult to engineer or too costly to market.

BRIEF SUMMARY OF INVENTION

The art of this invention takes a different approach by installing a mechanical device onto a conventional Venetian blind to enable it with selective tilting function for slats in the upper and lower regions set by the user.

The mechanical device of the present art is comprised of a master wheel assembly, one or multiple slave wheel assemblies, a shaft assembly, a control rod, as well as a plurality of pairs of cords and cord holders. Master and slave wheel assemblies are mounted on the front edge of a top slat along the horizontal width of a conventional Venetian blind.

The master wheel assembly is comprised of a set of a worm and a worm gear and two identical pull wheels. A control rod is connected to the worm for manual operation of the device of the present art. The worm gear is mated with the two pull wheels aligned with its axis of rotation, one on each side. A slave wheel assembly is comprised of a middle wheel and two pull wheels. The middle wheel is same as the worm gear except no gear teeth. The middle wheel is mated with the two pull wheels too aligned with its axis of rotation, one on each side. A shaft assembly connects the worm gear of a master wheel assembly and the middle wheels of all slave wheel assemblies to deliver synchronic rotations from the worm gear to all middle wheels.

Pull wheels, worm gears and middle wheels are created with specific features that allow a worm gear or a middle wheel to rotate the pull wheel at its one side in one direction without disturbing the pull wheel at its other side. The features also allow a worm gear or a middle wheel to rotate the pull wheel at its other side in the other direction while keeping the former pull wheel undisturbed.

A plurality of pairs of cords connect pull wheels and the front and rear edges of a user-selected slat using cord holders. The user-selected slat divides a Venetian blind into an upper and a lower region. The cords convert rotations of pull wheels to titling of all slats in the lower region without interfering with normal operations of the Venetian blind. With combined operations of the mechanical device of this art and the Venetian blind, slats in both lower and upper regions can be tilted selectively at angles up to 170 degrees.

By installing the device of the present art, users of Venetian blinds will be able to upgrade their blinds in an inexpensive, Do-It-Yourself way. Users will obtain the capability to partition their blinds into an upper and a lower region and to control the lower or upper regions selectively for both privacy and maximum natural lighting.

DETAILED DESCRIPTION OF EMBODIMENTS

The mechanical device of present invention is described in details with the provided figures herein.

Figure 1:
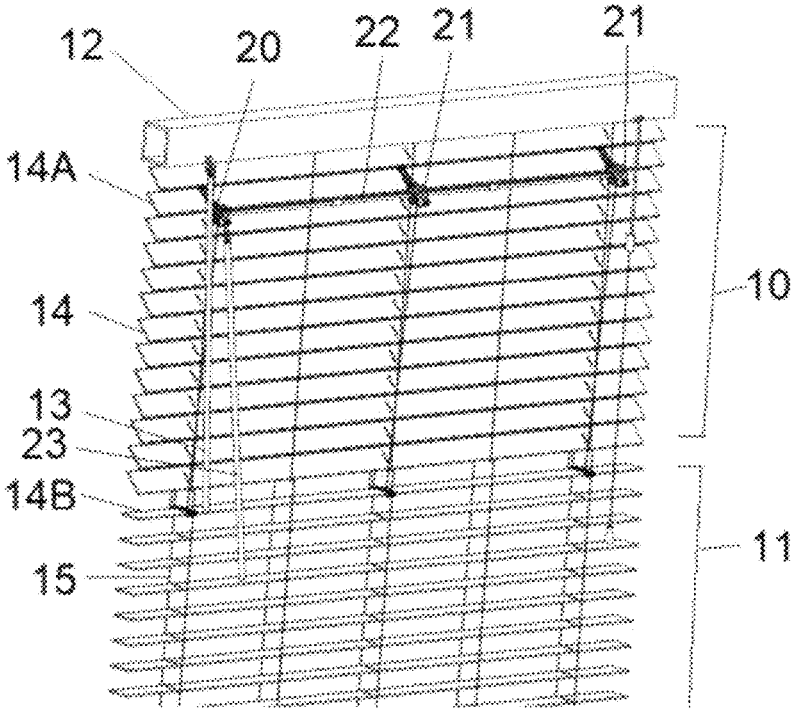
FIG. 1 is a perspective view of the device of present art mounted on a conventional Venetian blind whose upper region is set half close while its lower region is set fully open.

In FIG. 1, a device of the present art mounted on a typical conventional Venetian blind is illustrated; the upper region 10 of Venetian blind is half closed while the lower region 11 is open. The conventional Venetian blind consists of a cord control system, which is enclosed inside upper housing 12 and is operated with wand 13 for adjusting the tilting of the entire set of horizontal slats 14 via five string ladders 15. The device of the present art shown in FIG. 1 consists of one master wheel assembly 20, two slave wheel assemblies 21, one shaft assembly 22, one control rod 23. Master and slave wheel assemblies 20 and 21 are mounted at the positions of three of five string ladders 15 on the front edge (user-side edge) of a top slat 14A chosen by the user. Slat 14B is selected by the user as the partition to divide the upper and lower regions of Venetian blind. Two slave wheel assemblies 21 are driven by master wheel assembly 20 through shaft assembly 22.

Figure 2:
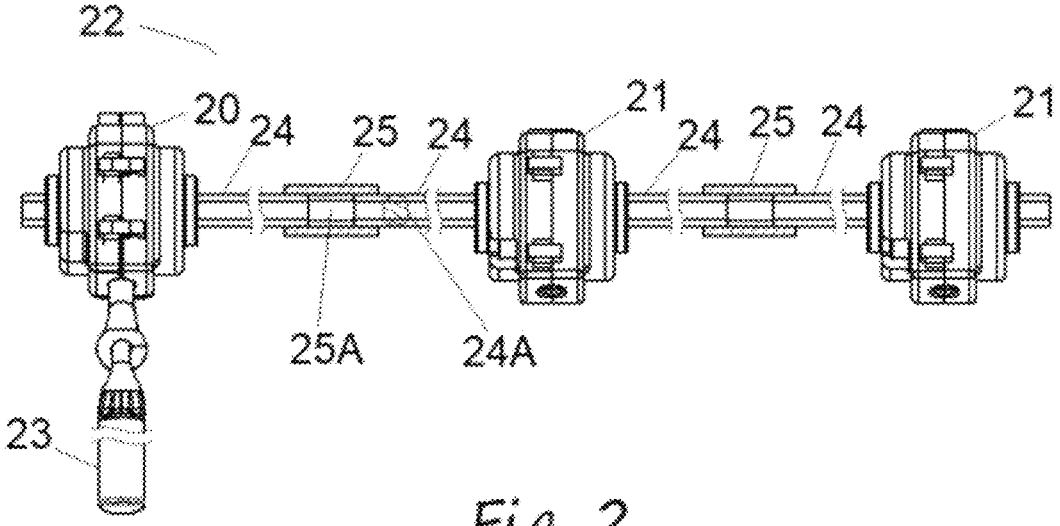
FIG. 2 is a top view of a shaft assembly of the device of present art that connects a master wheel assembly and two slave wheel assemblies in a row. Two rod connectors of shaft assembly are sectioned along shaft axis to show inner structures and mating relationship with rod shafts. A cross-section view of shaft rods is drawn inside a shaft rod.

A shaft assembly 22 is shown in FIG. 2, which comprises three shaft rods 24 and two rod connectors 25. Shaft rods 24 are long bars with cross-section of non-circular profile, which is shown in FIG. 2 as oblong cross-section profile 24A. Rod connectors 25 are tubes with cross-section profile of inner hole 25A same as the profile of cross-section 24A of shaft rods. Shaft rods 24 and shaft connectors 25 are mated to each other for transmitting rotational power from master wheel assembly 20 to slave wheel assemblies 21. Rod connectors 25 allows shaft rods 24 to slide inside their inner hole 25A. By sliding rod shafts, the distances among master and slave wheel assemblies 20 and 21 can be adjusted to fit to the locations of string ladders of Venetian blinds of different widths during mounting devices of present art. The shaft assembly 22 not only makes the device capable of fitting various blinds of different widths but also benefits product shipment of the device by shortening maximum packaging dimension.

Figure 3:
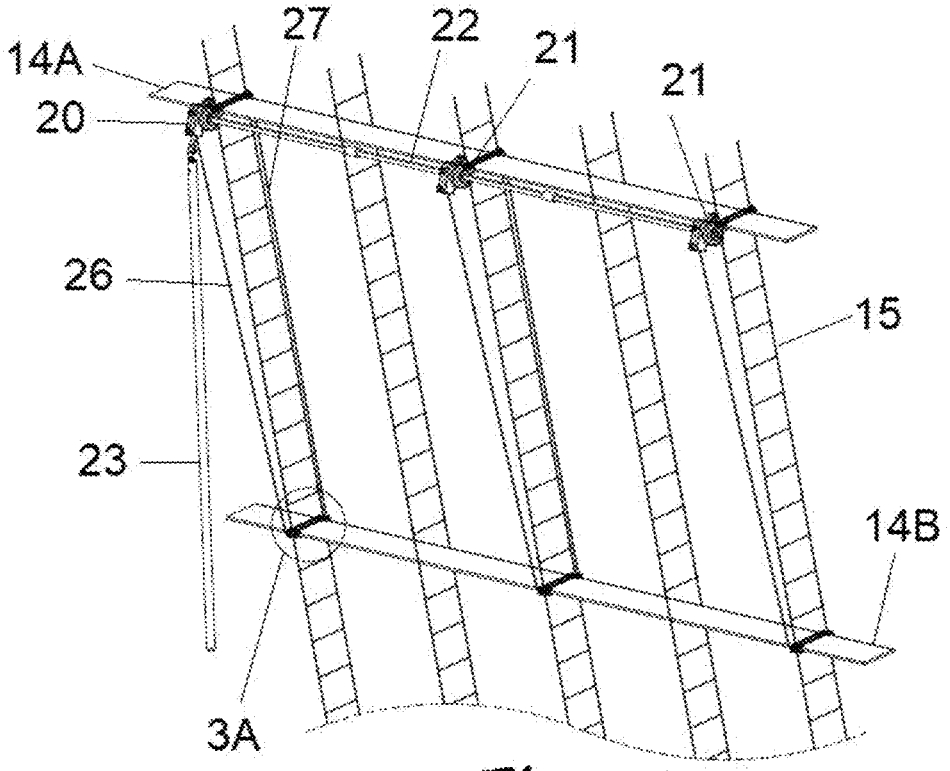
FIG. 3 is a perspective partial view of the device of present art mounted on a Venetian blind with some components of the blind removed in order to show overall installation relationship between the device and the blind.
Figure 4:
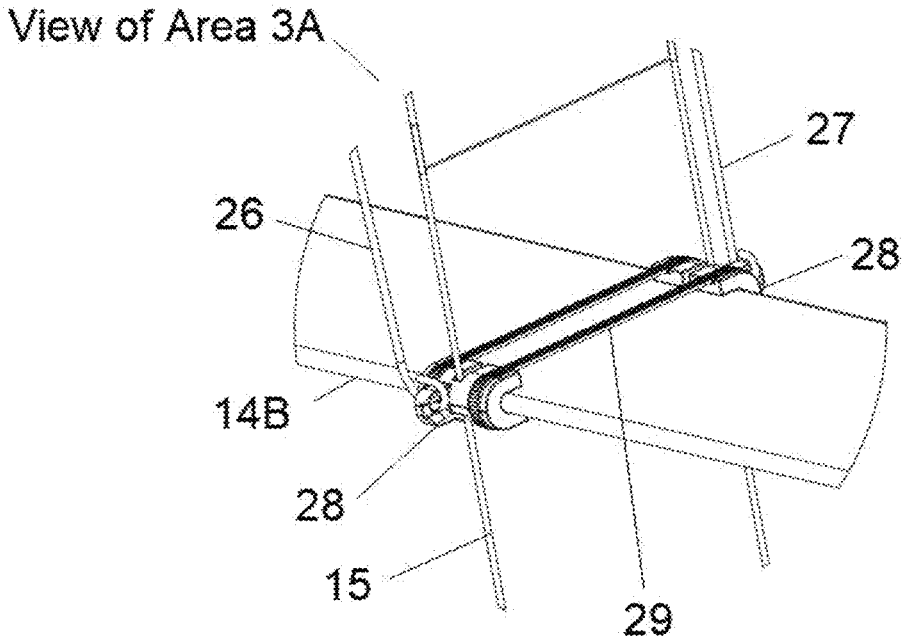
FIG. 4 is an enlarged area view of Area 3A in FIG. 3 in order to show details of the installation relationship among cord holders, slats, ladder strings, as well as front and rear cords.
Figure 5:
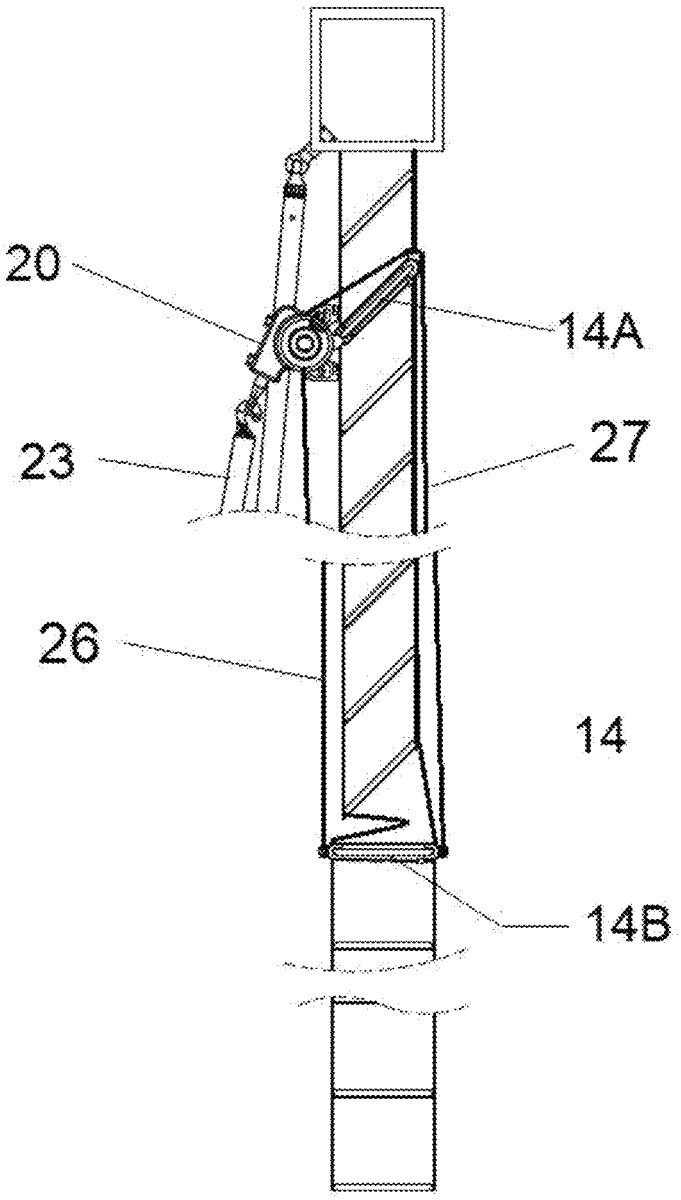
FIG. 5 is a side view of the device mounted on a Venetian blind for showing positions of components of the device with respect to the blind whose upper region is half-closed while the lower region is fully open.

Shown in FIG. 3, master wheel assembly 20 is operated manually with control rod 23. With shaft assembly 22, master and slave wheel assemblies 20 and 21 are rotated in sync so that the slats in lower region 11 can be adjusted at a desire angle while the slats in upper region 10 are not affected (FIG. 1). In order to make the slats in lower region 11 (FIG. 1) tilt at desired angles, three sets of front cords 26 and rear cords 27 connect their one end to master or slave wheel assemblies 20 or 21 and their other end to three pairs of identical cord holders 28 shown in FIG. 4. FIG. 4 is an enlarged area view of area 3A in FIG. 3. Referring to FIG. 3, FIG. 4 and FIG. 5, front cord 26 runs downward directly from master or slave wheel assembly 20 or 21 on the front side (user side) of the blind to the cord holder 28 at the front side; rear cord 27 runs rearward along the top of slat 14A from master or slave wheel assembly 20 or 21 and then downward along the rear side of the blind to the cord holder 28 at the rear side. Shown in FIG. 4, a pair of cord holders 28 at front and rear edges are tightened against slat 14B at the partition of the upper and lower regions 10 and 11 (FIG. 1) with two cable ties 29. The paired cord holders 28 at the front and rear sides are specifically featured in the way so that two cable ties 29 also fasten string ladder 15 against the two opposite edges of slat 14B and thus all slats below slat 14B can be tilted with slat 14B as a unit. Therefore, when master and slave wheel assemblies 20 and 21 pull front cords 26 up while keeping rear cords 27 free of moving, slat 14B and all slats in lower region 11 are tilted in one direction, and when they pull rear cords 27 up while keeping front cords 26 free of moving, slat 14B and all slats in lower region 11 (FIG. 1) are tilted in the other direction. This mechanics will be further detailed later. FIG. 5 also shows that tilting slats in lower region 11 (FIG. 1) with the device of present art does not interfere the tilting angle of slats in upper region 10 (FIG. 1). Therefore, the tilting of slats in lower region 11 (FIG. 1) can be controlled by the device of present art independently from the tilting of slats in upper region 10 (FIG. 1) controlled by cord control system of Venetian blind itself.

Figure 6:
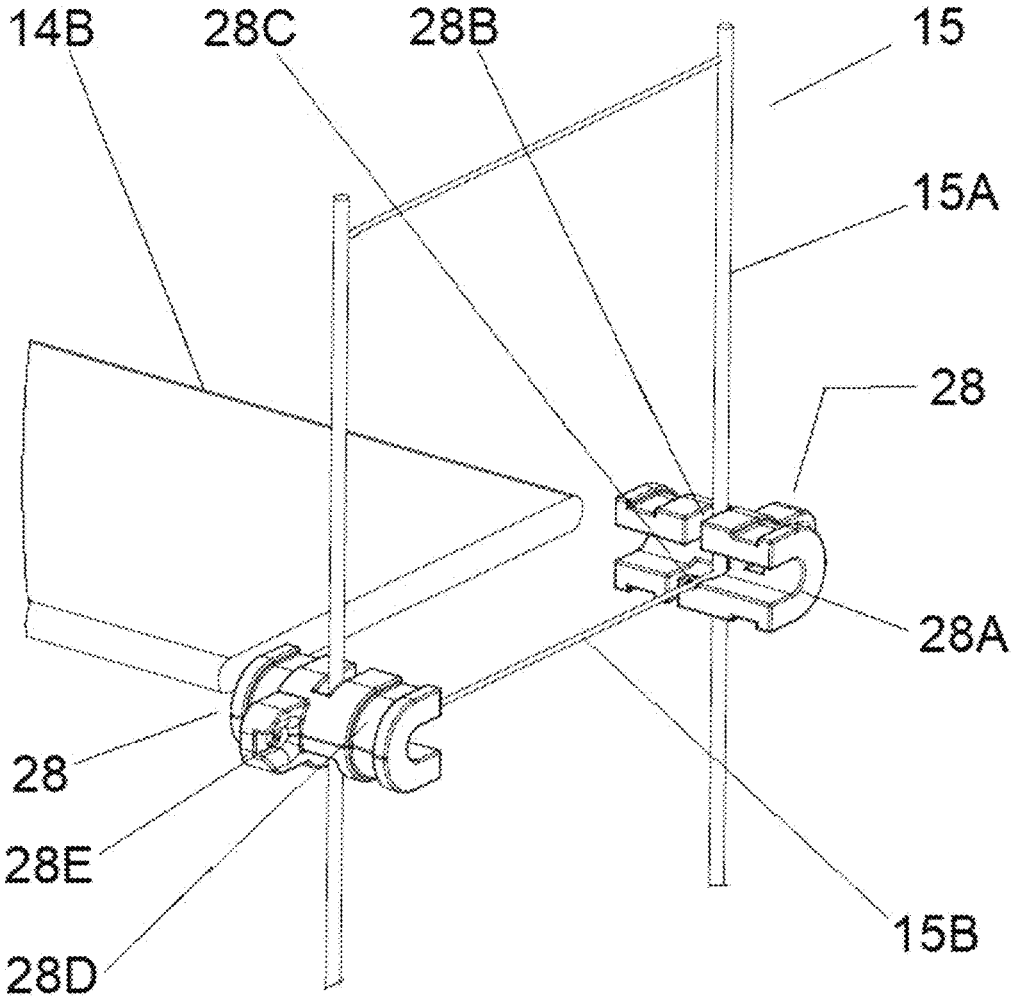
FIG. 6 is an exploded partial perspective view showing the embodiments of two cord holders and their installation relationship to a slat and a string ladder of a Venetian blind. The blind's slat is exploded off its position.

FIG. 6 shows a pair of cord holders 28 mounted at the front and rear edges of slat 14B that is exploded off its position to illustrate the specific features of the cord holders 28. Each of the cord holders 28 is characterized with: 1) a C-shaped body 28A for holding up to the edges of a slat 14B; 2) a vertical slot 28B for the vertical string 15A of a string ladder 15 to run through it and be held against slat 14B; 3) a horizontally placed finger 28C for holding up a horizontal string 15B of a string ladder 15 and preventing slip of vertical string 15A of a string ladder 15 to ensure all slats in lower region 11 (FIG. 1) to tilt together as a unit; 4) two guide grooves 28D for retaining two cable ties 29 at their positions shown in FIG. 4; 5) a through hole 28E for a front cord 26 or a rear cord 27 to be tightened and locked onto it as shown in FIG. 4. These features fasten a pair of front and rear cords 26 and 27 to the front and rear edges of slat 14B. The features also enable a pair of front and rear cord holders 28 to hold two vertical strings 15A and a horizontal string 15B of a string ladder 15 at the front and rear edges of slat 14B so that all slats in lower region 11 (FIG. 1) can be tilted together with slat 14B as a unit.

Figure 7:
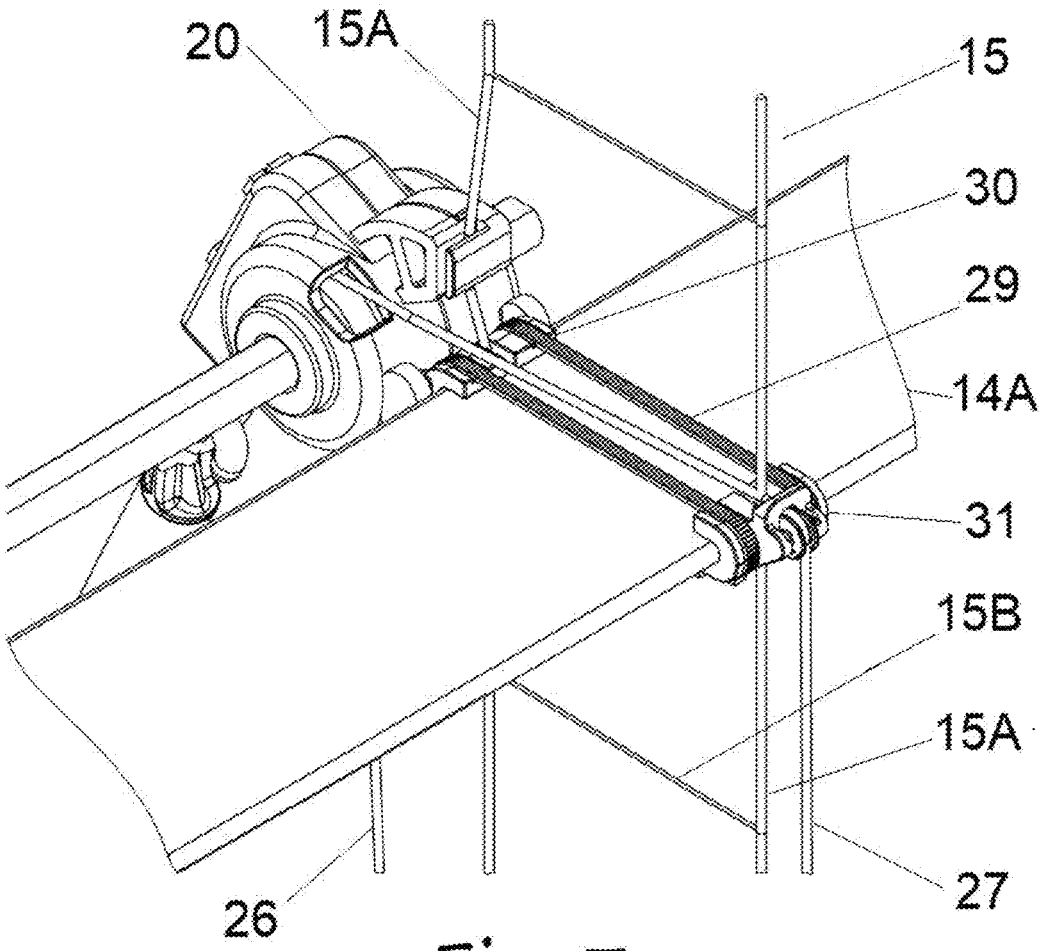
FIG. 7 is a partial perspective view showing the installation relationship of the master wheel assembly with a top slat and a string ladder of a Venetian blind; it also shows the route of a front cord and a rear cord of the device of present art.
Figure 8:
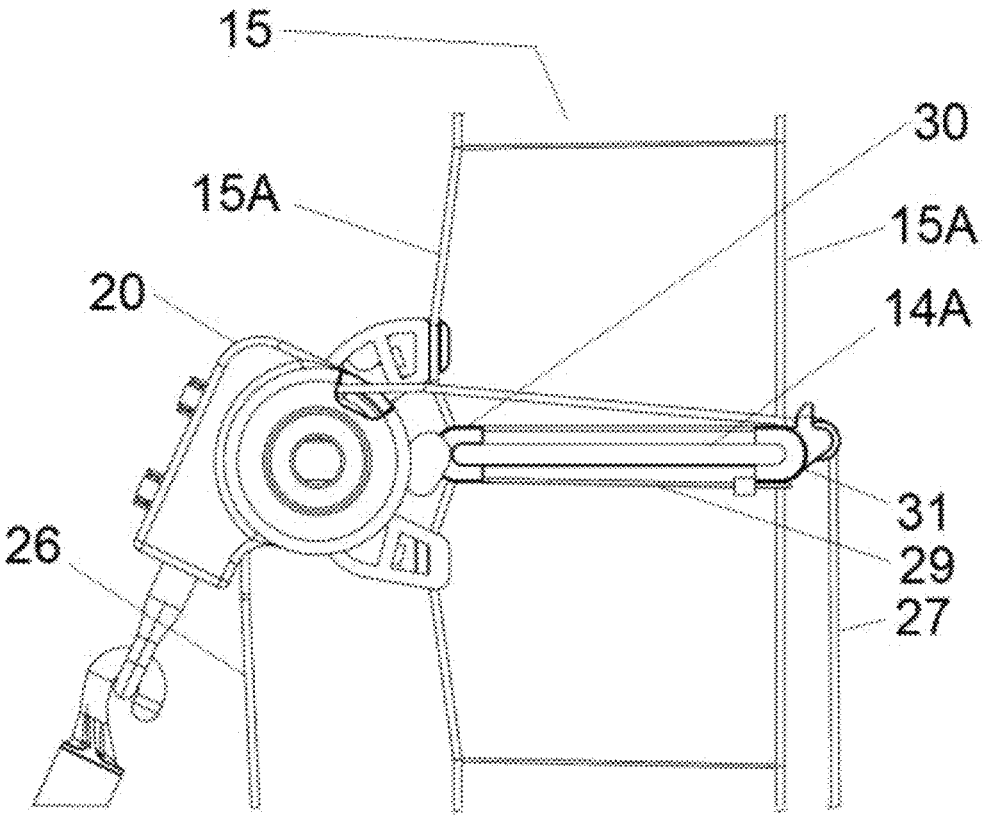
FIG. 8 is a partial side view showing the installation of master wheel assembly with a top slat and a string ladder of a Venetian blind; the route of a front cord and a rear cord of the device of present art are also shown.

FIG. 7 and FIG. 8 show how a master wheel assembly 20 is mounted at the front edge of slat 14A in upper region 10 (FIG. 1) together with two vertical string 15A and a horizontal string 15B of string ladder 15, utilizing a front clamp 30 and a rear clamp 31 that are tightened onto slat 14A by two cable ties 29. Master wheel assembly 20 holds the front vertical string 15A at both its upper and lower sides to keep its vertical orientation. FIG. 7 and FIG. 8 also show in details how a front cord 26 runs directly downward from a master wheel assembly 20 and how a rear cord 27 runs rearward above slat 14A from a master wheel assembly 20 then runs downward.

Figure 9:
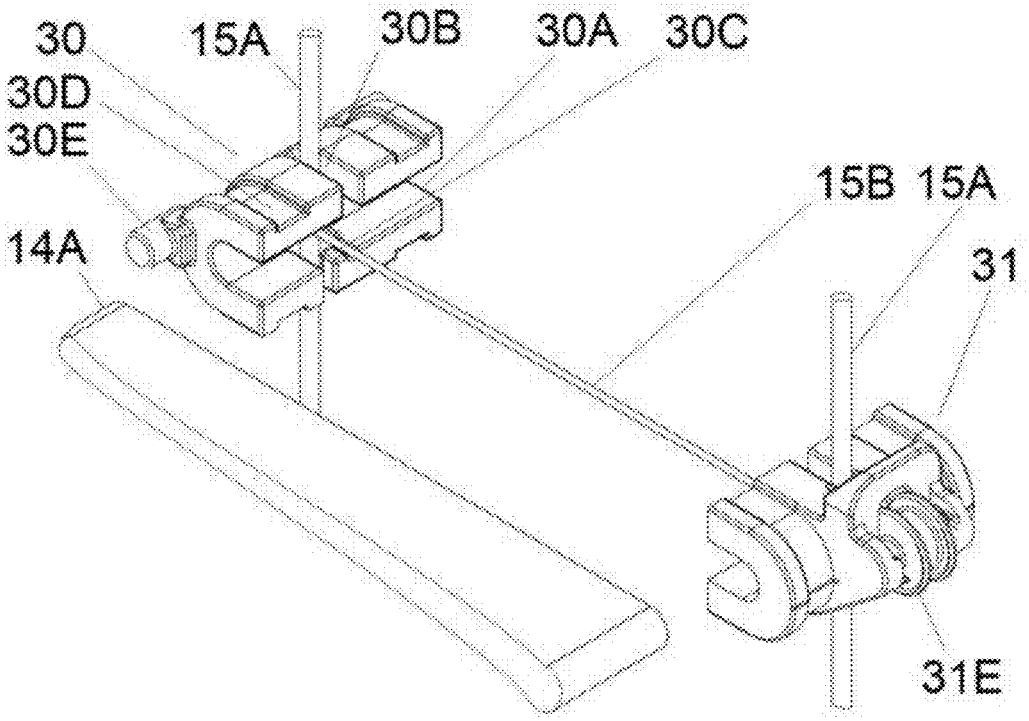
FIG. 9 is an exploded partial perspective view detailing installation of a front clamp and a rear clamp to a top slat of a Venetian blind. The blind's slat is exploded off its position.
Figure 10:
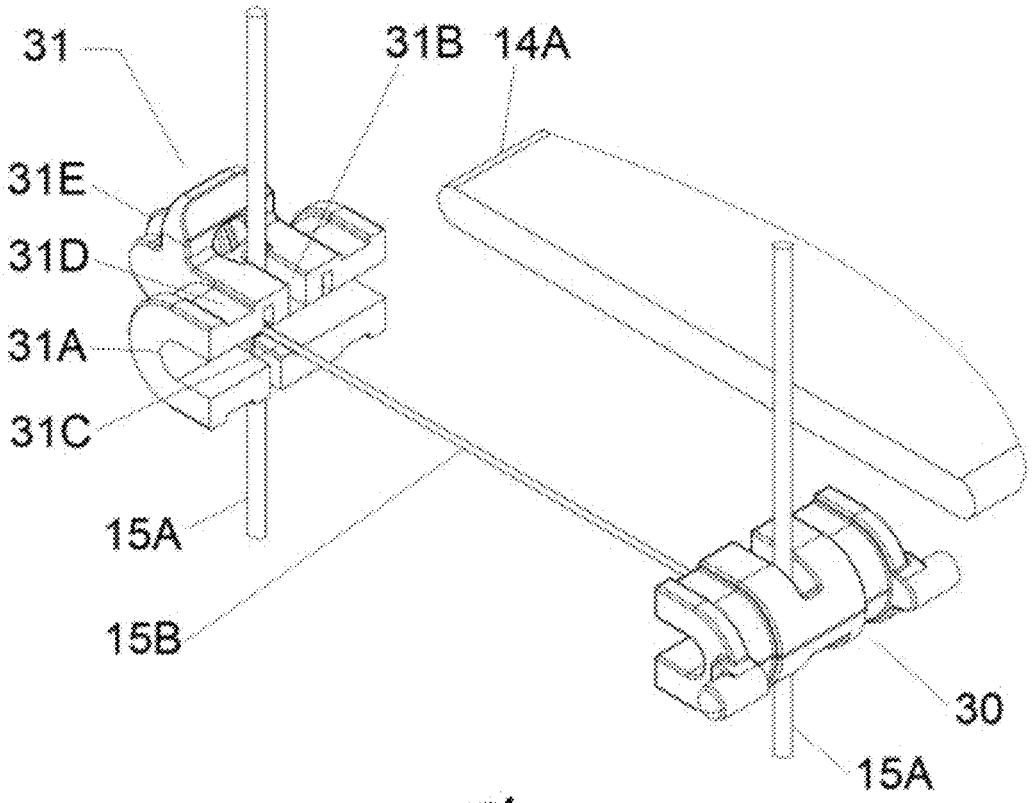
FIG. 10 is an exploded partial perspective view same as FIG. 9 but from different viewing direction, detailing installation of front clamp and rear clamp to a top slat of a Venetian blind. The blind's slat is exploded off its position.

Both FIG. 9 and FIG. 10 show the features of a front clamp 30 and a rear clamp 31 from different viewing directions. The features of both front and rear clamps 30 and 31 are similar to features of cord holders 28 shown in FIG. 6 but with slight differences.

Front clamp 30 is characterized with: 1) a C-shaped body 30A that is able to clamp onto the front or rear edge of slat 14A for mounting; 2) a vertical slot 30B for a vertical string 15A to run through and to be tightened against slat 14A; 3) a horizontally placed finger 30C for holding up a horizontal string 15B and preventing slip of vertical string 15A; 4) two guide grooves 30D for retaining two cable ties 29 (FIG. 7); 5) two cylindrical bosses 30E located on each side plane of C-shaped body 30A for mating with and supporting master wheel assembly 20 (FIG. 7).

Rear clamp 31 is characterized with: 1) a C-shaped body 31A similar to that of body 30A; 2) a vertical slot 31B same as vertical slot 30B; 3) a horizontally placed finger 31C same as finger 30C; 4) two guide grooves 31D same as guide grooves 30D; 5) a roller 31E for a rear cord 27 to be guided and turned around as shown in FIG. 7.

Figure 11:
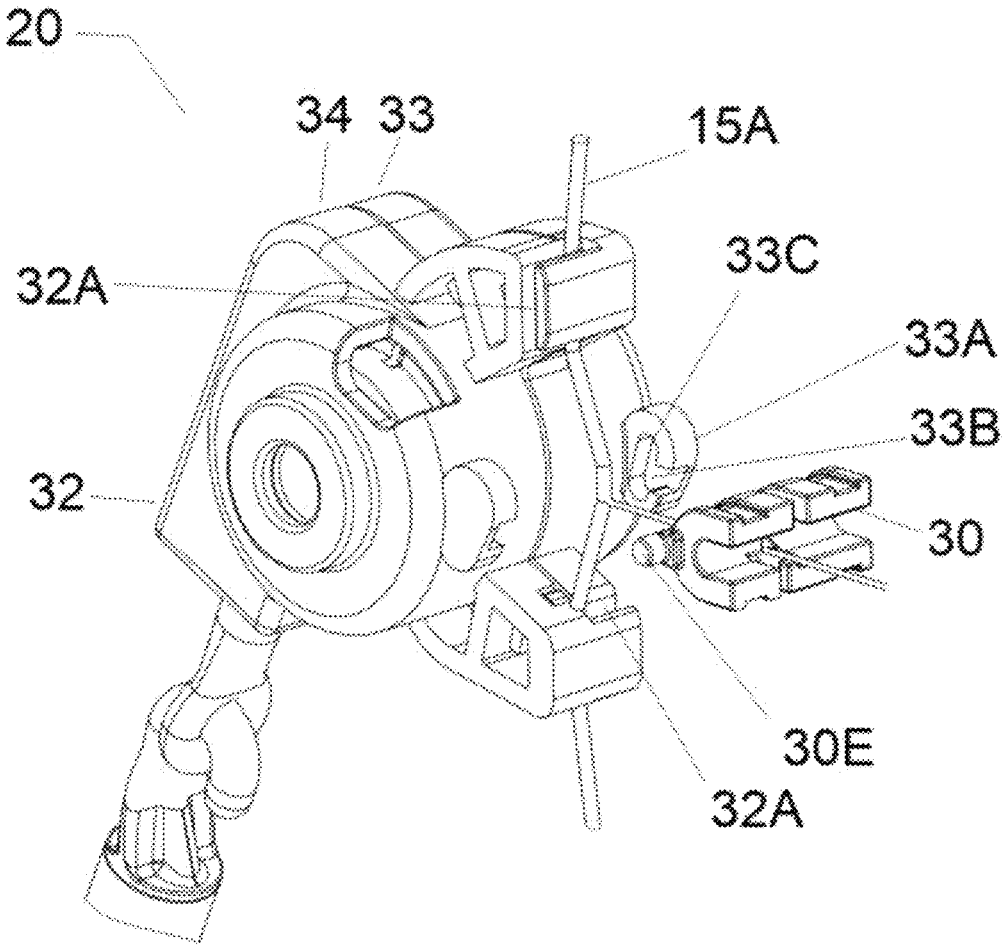
FIG. 11 is an exploded partial perspective view detailing features of an enclosure of a master wheel assembly. A front clamp mated with the enclosure is exploded off its position.

FIG. 11 shows the features of the enclosure 32 of a master wheel assembly 20. Enclosure 32 encloses and supports components of master wheel assembly 20 and is capable of being mounted onto Venetian blind with front clamp 30. Mounting of enclosure 32 needs to keep master wheel assembly 20 in a vertical orientation in order for front cord 26 and rear cord 27 (FIG. 8) to work properly. Enclosure 32 can be split into two halve: left half-enclosure 33 and right half-enclosure 34, which are shown also in FIG. 12 as an exploded view. In FIG. 11, each of left and right half-enclosures 33 and 34 have an ear-shaped feature 33A on which a T-shaped groove 33B is formed. At the very top end of T-shaped groove 33B is a semi-cylindrical recess 33C. T-shaped groove 33B is connected smoothly with semi-cylindrical recess 33C for both cylindrical bosses 30E of a front clamp 30 detailed in FIG. 9 to slide inside. The bosses 30E (FIG. 9) slide along two grooves 33B and then mate with semi-cylindrical recesses 33C. The two grooves 33B simplify the mounting of master wheel assembly 20. Also shown in FIG. 11, left and right half-enclosures 33 and 34 form two slots 32A, one at top and one at bottom, after being closed together. The openings of the two slots 32A are formed horizontally opposite to each other for purpose to clip and retain a vertical string 15A securely inside them. Slots 32A ensure master wheel assembly 20 always maintains its vertical orientation as shown in FIG. 8.

Figure 12:
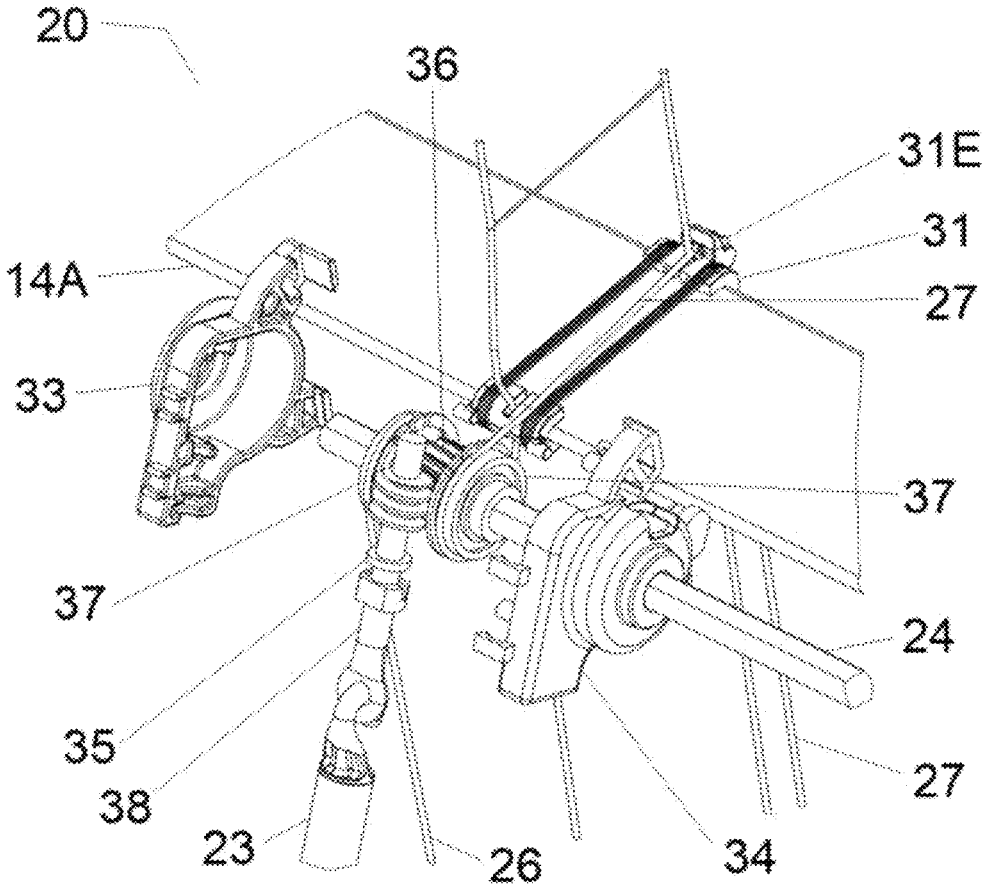
FIG. 12 is an exploded partial perspective view detailing a master wheel assembly. The left and right half-enclosures are exploded off their positions.

FIG. 12 shows all components of master wheel assembly 20 and their installation relationship with other parts. To be precise, master wheel assembly 20 consists of a worm 35, a worm gear 36, two pull wheels 37, a control rod 23, a control rod adapter 38, and an enclosure 32 (FIG. 11). The enclosure 32 is formed by a left half-enclosure 33 and a right half-enclosure 34. In FIG. 12, shaft rod 24 mates with worm gear 36 to deliver synchronized rotation to slave wheel assemblies 21 discussed in FIG. 2 and FIG. 3; control rod 23 is connected to worm 35 through control rod adapter 38; manual rotation of control rod 23 can be conveyed to the rotation of worm 35 then to the rotation of worm gear 36 and then to either one of the two identical pull wheels 37 located oppositely at the two sides of worm gear 36. Front cord 26 runs from left pull wheel 37 to cord holder 28 (FIG. 6) at the front side of the Venetian blind, and rear cord 27 runs from right pull wheel 37 across the top of slat 14A and around roller 31E on clamp 31 to cord holder 28 (FIG. 6) at the rear side of the Venetian blind. Two pull wheels 37 lift or release front cord 26 or rear cord 27 so as to tilt slat 14B in lower region 11 as discussed in FIG. 1, FIG. 3, FIG. 4, and FIG. 5.

Figure 13:
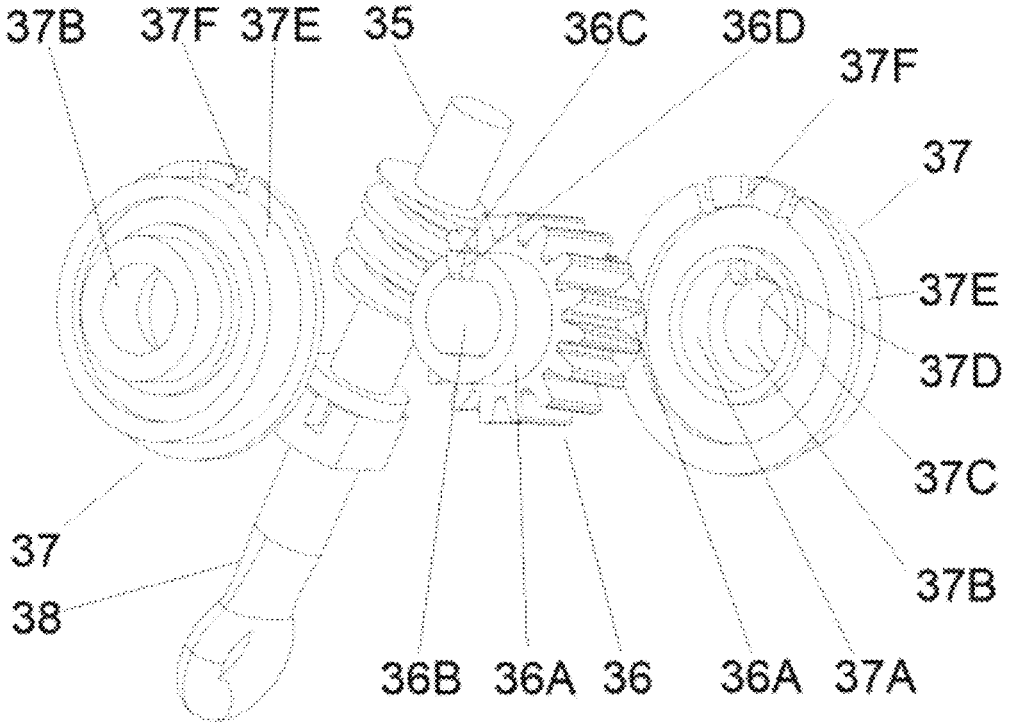
FIG. 13 is an exploded perspective view detailing features and relationships of gears and wheels enclosed inside a master wheel assembly. Two identical pull wheels are exploded off their positions.

Gears and wheels inside the enclosure of master wheel assembly 20 (FIG. 11) are shown in FIG. 13. Control rod adapter 38 makes rotational connection between worm 35 and control rod 23 shown in FIG. 12 for manual operation of the device of this present art. Worm gear 36 has two coaxial cylindrical columns 36A located on the two sides of teeth for mating with the two pull wheels 37 oppositely aligned to the rotational axis. A through hole 36B is designed at the center of worm gear 36 for shaft rod 24 (FIG. 12) to run through. The cross-section profile of the through hole 36B is the same as the cross-section profile of shaft rod 24 so that worm gear 36 and shaft rod 24 can be mated to each other and rotate together (refer to FIG. 12). Worm gear 36 also has two axial bosses 36C standing perpendicularly on the outside faces of the two cylindrical columns 36A. Either of the two bosses 36C functions as a key to rotate a pull wheel 37. The inner part of pull wheel 37 has two coaxial cylindrical holes 37A and 37B of different diameters. The two cylindrical holes 37A and 37B are connected to each other at a side face and create a pass for shaft rod 24 to run through and rotate independently (refer to FIG. 12). Between the two cylindrical holes 37A and 37B, there is an axial boss 37C that stands perpendicularly on the inner side face shared by both holes 37A and 37B. A cylindrical column 36A of worm gear 36 is mated with the cylindrical hole 37A of a pull wheel 37. Both axial boss 36C of a worm gear 36 and axial boss 37C of a pull wheel 37 have two planar flanks 36D and 37D respectively for them to mate to each other. When worm gear 36 rotates, one of two axial bosses 36C of a worm gear 36 will contact and mate with only one axial boss 37C of a pull wheel 37 with flanks 36D and 37D, so only one of the two pull wheels 37 is pushed to rotate together with the worm gear 36. Therefore, manipulation of the control rod 23 (FIG. 12) in one direction will cause one axial boss 36C of the worm gear 36 to contact one axial boss 37C of a pull wheel 37 at its one side and rotate the pull wheel 37 in one direction without disturbing the pull wheel 37 at its other side for approximately 330 degrees of rotation. If the control rod 23 (FIG. 12) is manipulated in the opposite direction, the opposing axial boss 36C of the worm gear 36 will contact the axial boss 37C of the opposing pull wheel 37 and rotate the opposing pull wheel 37 in the opposite direction without disturbing the former pull wheel 37 for approximately 330 degrees of rotation. The outer part of pull wheel 37 is a cylinder 37E on which three slots 37F are cut. A front cord 26 or a rear cord 27 (FIG. 12) is wrapped around the surface of the cylinder 37E after being locked in place with slots 37F. In FIGS. 12 and 13, when manipulation of the control rod 23 engages an axial boss 36C of worm gear 36 and the axial boss 37C of the left-side pull wheel 37 and causes the left-side pull wheel 37 to rotate, the front cord 26 locked at slots 37F of the left-side pull wheel 37 will be lifted and wrapped around the surface of the cylinder 37E of the left-side pull wheel 37. Simultaneously the rear cord 27 locked with slots 37F of the right-side pull wheel 37 remains undisturbed for approximately 330 degrees. When control rod 23 (FIG. 12) is manipulated in opposite direction and makes the right-side pull wheel 37 rotate in opposite direction, the rear cord 27 will be lifted and wrapped around the surface of the cylinder 37E of the right-side pull wheel 37 while the front cord 26 is undisturbed.

Figure 14:
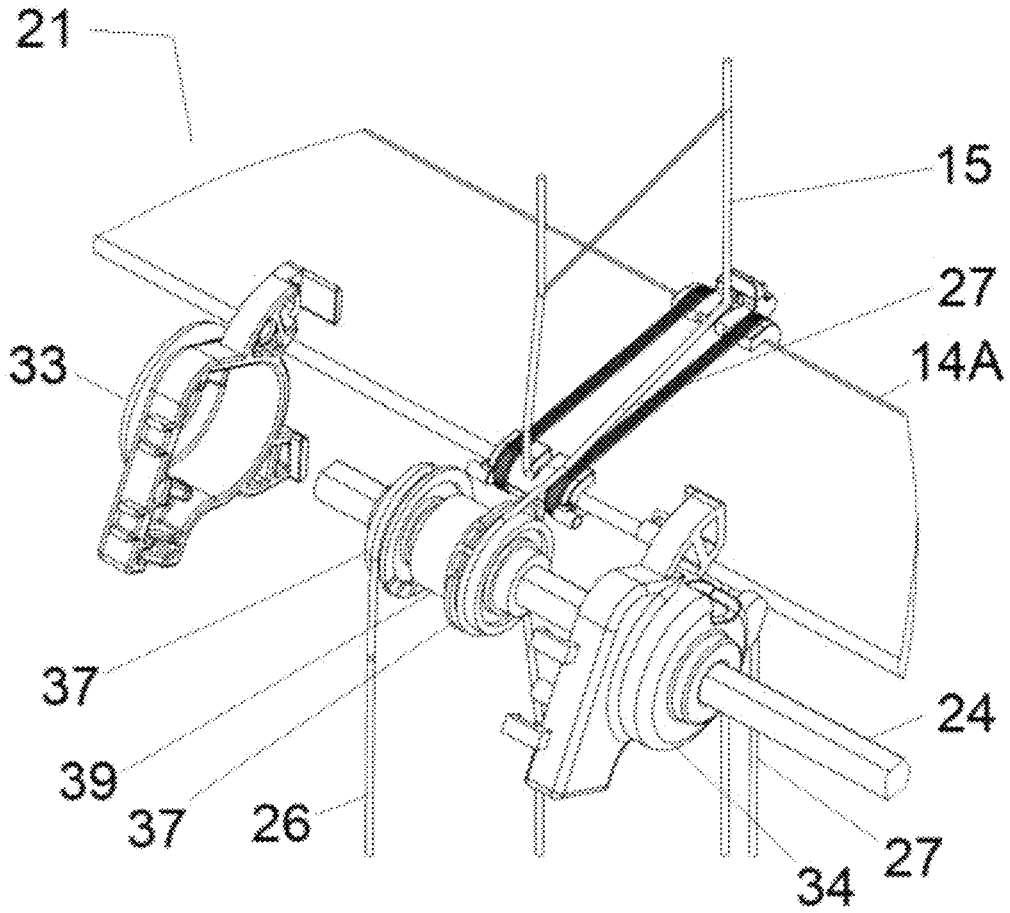
FIG. 14 is an exploded partial perspective view detailing a slave wheel assembly. The left and right half-enclosures are exploded off their positions.

All components of a slave wheel assembly 21 and their relationship with other parts are shown in FIG. 14. Precisely, a slave wheel assembly 21 is comprised of a middle wheel 39, two identical pull wheels 37, and an enclosure 32 (FIG. 11) that is constructed by right half-enclosure 33 and left half-enclosure 34. Two pull wheels 37 and enclosure 32 are identical to the same parts utilized in master wheel assembly 20 (FIG. 12). The mounting of a slave wheel assembly 21 is exactly the same as the mounting of master wheel assembly 20 (FIG. 12) described in the above paragraphs and related figures. Middle wheel 39 is exactly same as worm wheel 36 (FIG. 13) except having no teeth, and it mates with the two pull wheels 37 and shaft rod 24 in the exactly same way as worm wheel 36 does, which is shown in FIG. 13 and is described in the previous paragraphs. In FIG. 14, shaft rod 24 is mated with and conveys rotation to middle wheel 39, which then drives either one of the two pull wheels 37 to lift up cord 26 or rear cord 27 and tilt slat 14B (FIG. 5). Therefore, manipulating the control rod of the device of present art results in tilting of slats in the lower region without interfering operation of Venetian blind.

The provided drawings are for the purpose of demonstration of principles, functionalities, effectiveness, and detailed geometrical features of the present art. The provided drawings are not intended to make any definition of the limits of the present invention.

I claim:

1. A mechanical device comprising: at least two sets of front clamps and rear clamps, wherein the front clamps can be fastened at the front edge of a slat at the top of a conventional Venetian blind and the rear clamps can be fastened at the rear edge of the same slat hereof;

a master wheel assembly comprised of:

an enclosure mated with one of said front clamps thereof so as to be mounted at the front edge of the slat at the top of the Venetian blind thereof, a set of worm and worm gear enclosed inside the enclosure thereof, two identical pull wheels mated oppositely at the two axial sides of the worm gear thereof and also enclosed inside the enclosure thereof, and a control rod adaptor connected to the worm thereof at its one side and to a control rod at its other side for manual operation of the mechanical device thereof;

one or multiple slave wheel assemblies comprised of:

an enclosure mated with one of said front clamps thereof so as to be mounted at the front edge of the said slat at the top of the Venetian blind thereof, a middle wheel enclosed inside the enclosure thereof, and two identical pull wheels mated oppositely at the two axial sides of the middle wheel thereof and also enclosed inside the enclosure thereof;

one shaft assembly comprised of at least two shaft rods connected by at least one shaft connector; wherein shaft assembly connects the worm gear of the master wheel assembly thereof and the middle wheels of slave wheel assemblies thereof for transmitting rotations;

at least two pairs of front cord holders and rear cord holders, wherein the front cord holders are tightened onto the front edge of a user-selected slat that partitions the Venetian blind thereof into upper and lower regions; the rear cord holders are tightened onto the rear edge of the same slat hereof;

at least two front cords, wherein one end of a front cord is tightened onto one of the pull wheels thereof and the other end onto one of the front cord holders thereof;

at least two rear cords, wherein one end of a rear cord is tightened onto the opposing pull wheel thereof and the other end onto one of the rear cord holders thereof; and a plurality of cable ties for tightening the front and rear clamps and cord holders thereof against said slats of the Venetian blind thereof.

2. The mechanical device of claim 1, wherein each of the front clamps comprises:

a C-shaped body for clamping onto the front edge of a top slat of the Venetian blind thereof, a vertical slot allowing a vertical string of a string ladder of the Venetian blind thereof to run through and be tightened against the front edge of said top slat of the Venetian blind thereof, a horizontally placed finger for holding up a horizontal string of a string ladder of the Venetian blind thereof and preventing slip of the vertical string of the string ladder of the Venetian blind hereof, two grooves for retaining cable ties thereof, and two cylindrical bosses placed horizontally at the two side planes of C-shaped body thereof for mating to one of enclosures thereof.

3. The mechanical device of claim 1, wherein each of the rear clamps comprises:

a C-shaped body for clamping onto the rear edge of a top slat of the Venetian blind thereof, a vertical slot allowing a vertical string of a string ladder of the Venetian blind thereof to run through and be tightened against the rear edge of said top slat of the Venetian blind thereof, a horizontally placed finger for holding up a horizontal string of a string ladder of the Venetian blind thereof and preventing slip of the vertical string of the string ladder of Venetian blind hereof, two grooves for retaining cable ties thereof, and a roller for a front or rear cord thereof to be guided and turned around.

4. The mechanical device of claim 1, wherein the enclosure is constructed from at least two parts and comprises:

two cylindrical recesses for mating with two cylindrical bosses of the front clamp thereof, wherein the cylindrical recess is smoothly connected with a T-shaped groove for guiding the two cylindrical bosses of a front clamp thereof to the mating position during installation, and two C-shaped slots with their openings to be formed horizontally opposite to each other for a vertical string of a string ladder of the Venetian blind thereof to be clipped onto and retained inside.

5. The mechanical device as defined in claim 1, wherein the shaft assembly comprises:

at least two shaft rods with non-circular cross-section profile, and at least one shaft connector featured as a tube with its inner hole cross-section profile same as the cross-section profile of shaft rods thereof, which are therefore able to mate with and slide inside the inner hole of shaft connect hereof for transmitting rotations and adjusting length of the shaft assembly hereof.

6. The mechanical device of claim 1, wherein the worm gear comprises:

two coaxial cylindrical columns located on both sides of teeth of worm gear hereof for mating rotationally with two pull wheels thereof, one for each, two axial bosses with two planar flanks standing out perpendicularly at the side face of the two cylindrical columns thereof and functioning as keys to rotate either of two pull wheels thereof, and a cylindrical through hole at the center with the same cross-section profile as the shaft rods of the shaft assembly thereof for one of the shaft rods hereof to fit with and run through for transmitting rotations.

7. The mechanical device as defined in claim 1, wherein each of the identical pull wheels comprises:

a cylinder as outer part of the pull wheel thereof for one of the front or rear cords thereof to wrap around, wherein at least two slots are cut out on the surface of the cylinder hereof for locking one end of the cord hereof, two connected coaxial cylindrical holes of different diameters at the center of the cylinder thereof allowing one shaft rod of the shaft assembly thereof to run through and rotate independently, wherein the cylindrical hole of larger diameter mates rotationally with one of the two cylindrical columns of the worm gear thereof, and a boss with two planar flanks standing out perpendicularly at the inner side face shared by two cylindrical holes thereof and mating with one of the two axial bosses of the worm gear thereof for receiving rotational power.

8. The mechanical device as defined in claim 1, wherein the middle wheel is same as the worm gear thereof except no gear tooth.

9. The mechanical device of claim 1, wherein the front and rear cord holders comprise:

a C-shaped body for clamping onto the front or rear edge of a slat of the Venetian blind thereof, a vertical slot allowing a vertical string of a string ladder of the Venetian blind thereof to run through and to be tightened against the edge of the slat of the Venetian blind thereof, a horizontally placed finger for holding up a horizontal string of a string ladder of the Venetian blind thereof and preventing slip of the vertical string of a string ladder of the Venetian blind thereof, two grooves for retaining cable ties thereof, and a through hole or slot for tightening or locking an end of a front or rear cord thereof.

* * * * *